US006726604B2

(12) United States Patent
Verdun

(10) Patent No.: US 6,726,604 B2
(45) Date of Patent: Apr. 27, 2004

(54) SPORT JUMP APPARATUS

(75) Inventor: Eric Adam Verdun, Patterson, LA (US)

(73) Assignee: Eric A. Verdun, Patterson, LA (US)

( * ) Notice: Subject to any disclaimer, the term of this patent is extended or adjusted under 35 U.S.C. 154(b) by 0 days.

(21) Appl. No.: 10/127,797

(22) Filed: Apr. 23, 2002

(65) Prior Publication Data

US 2003/0199367 A1 Oct. 23, 2003

(51) Int. Cl.[7] ..... A63B 5/20

(52) U.S. Cl. ..... 482/81; 482/82

(58) Field of Search ..... 482/81, 82; 446/247–249, 446/236–231; 434/112

(56) References Cited

U.S. PATENT DOCUMENTS

| | | | | | |
|---|---|---|---|---|---|
| 4,739,985 | A | * | 4/1988 | Rudell et al. | 482/81 |
| 5,464,376 | A | * | 11/1995 | Weston et al. | 482/81 |
| 5,470,296 | A | * | 11/1995 | Welte | 482/81 |
| 5,496,204 | A | * | 3/1996 | Brown et al. | 482/81 |
| 5,888,179 | A | * | 3/1999 | Singhal | 482/81 |
| 5,931,766 | A | * | 8/1999 | Cooper | 482/81 |

* cited by examiner

*Primary Examiner*—Jerome W. Donnelly

(57) ABSTRACT

The Sport Jump Apparatus is a jumping apparatus for developing a human's alacrity and also provides an aerobic, anaerobic, and physical exercise to the body. The human's alacrity is the ability to act quickly and move rapidly using both mental and physical skills in reacting to events and objects that invade the space immediately surrounding a person.

A unique and innovated piece of exercise equipment consisting of a hard plastic or fiberglass-coated octagon base four sided molded A frame (approximately 21" tall). An internal battery-powered motor (rechargeable 12 volts), the variable speed motor has a fitted control panel that houses the on-off switch, the variable speed switch, the 5-second delay switch and charger jack located near the center on the outside of the frame allowing the user to manually or remote control the motor's speed as desired. The motor would be designed to rotate or pulsate back and forth at 180 and/or 360 degrees driving the telescoping shaft, attached to the telescoping shaft using the 90 degree collars, the horizontal extending arm, approximately 7" in length, the vertical extension leg, approximately 17" in length, and the horizontal extension bar approximately 16–30 in length, with the collars, arms, leg, and bar having a Z-shape design, with the telescoping shaft being adjustable and the horizontal extension bar being adjustable to various lengths, depending on the user's specific needs. As the user adjust the telescoping shaft to a desired height and the horizontal extension bar at a desired length the apparatus would then be set for operation. As the individual activate the apparatus, the horizontal extension bar would pulsate or rotate at a desired pace, allowing the jumper to jump over the horizontal extension bar in the defined area.

5 Claims, 5 Drawing Sheets

SPORT JUMP APPARATUS

BACKGROUND OF THE INVENTION

1. Field of the Invention

The Sport Jump Apparatus is that of a newly designed piece of exercising equipment that improves a person's vertical jump, coordination skills and confidence. This apparatus is a self-contained powered motor that allows an individual of all age both a physical and cardiovascular workout at a variable height and pace for jumping in a defined area.

2. Description of the Related Art

Numerous exercise machines and devices of various kinds that are used for exercising the human body. These machines use many varieties of exercise techniques such as: lifting weights, aerobic stepper, recumbent bike and motorized treadmill. These exercise machines do not specifically exercise and develop the alacrity of the human body. The human alacrity is the ability to act quickly and move rapidly using both mental and physical skills in reacting to events and objects that invade the space immediately surrounding a person. The alacrity skills when developed through an exercise apparatus are useful in improving reaction time skills and providing physical exercise. They may also be useful in improving the competitors' ability for those that arc in training for all sorts of sports and activities.

SUMMARY OF THE PRESENT INVENTION

The Sport Jump Apparatus is an exercising and jump apparatus that would provide the user with a very easy to use and safe method in developing the human alacrity and also provides an aerobic, anaerobic, and physical exercise to the body. The human alacrity embodying the ability to act quickly and more rapidly using both mental and physical skills in reacting to events and objects that invades the space immediately surrounding a person. The alacrity skills when developed through this exercise apparatus are useful in giving the body a balanced mental and physical exercise, enables a heightened mental state of awareness and readiness while indulging in physical exercise of the body, thereby proving a balanced exercise to the exercise subject.

An object and advantage of the invention are that it improves a person vertical jump and the human alacrity without the use of bulky and expensive equipment.

An additional object and advantage of the invention are that the apparatus may be utilized in a space smaller than that's required for bulky and expensive equipment. Moreover, a minimal amount of floor space and vertical space is required for the apparatus.

An additional object and advantage of the invention are that the speed of the rotation or pulsating of the horizontal extension bar may be adjusted as desired by the individual and may be adjusted during the jumping exercise by hand or with a remote transmitter.

An additional object and advantage of the invention are that the apparatus can be designed for a single jumper as well as dual jumper for exercising.

An additional object and advantage of the invention that the jumper can adjust the desired height of the horizontal extension bar by lifting or lowering the telescoping shaft and locking the telescoping shaft in position.

A further object and advantage of the invention are that during the exercises, the apparatus permits other exercises to be simultaneously performed with the arms and legs such as boxing or free weights.

A further object and advantage of the invention as a safety precaution, the invention would be designed to have a five (5) second delay switch that would shut off power to the apparatus in the event that it would be accidentally tipped over.

A still further object and advantage of the present invention are to provide a jumping and exercising apparatus that are economical in cost to manufacture, that is simple and easy to use and environmentally safe.

A still further object and advantage of the invention are that the internal motor can be built to pulsate 180 and/or 360 degrees rotating the telescoping shaft.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DETAILED DESCRIPTION OF THE INVENTION

The Sport Jump Apparatus is jumping apparatus for developing a human's alacrity and also provides an aerobic, anaerobic and physical exercise to the body. The human's alacrity is the ability to act quickly and move rapidly using both mental and physical skills in reacting to events and objects that invade the space immediately surrounding a person.

Figure 1:
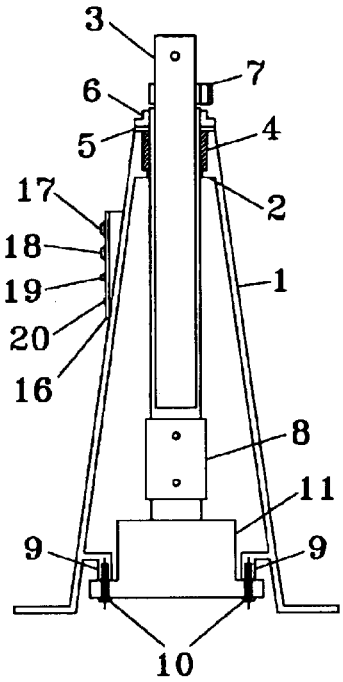
FIG. 1 shows the internal view of the apparatus.

The Sport Jump Apparatus is described with reference to FIG. 1–3. The principal elements shown in these three (3) view consist of a plastic or fiberglass molded—four (4) sided A-frame 1, an internal motor 11 and a vertical telescoping shaft 3 mounted in the center of the A-frame 1.

The Sport Jump Apparatus comprises a molded four side A-frame 1 of a plastic or fiberglass material (app. 21" tall) with an octagon base not shown, (app. 14" wide). The A-frame 1 is constructed and composed of a bearing seat 1 that is molded in the top center of the A-frame 1 that the shaft bearing 4 is appropriately sized to fit. The A-frame 1 also composes the (4) motor mounts 9, which is molded near the bottom of the A-frame 1 that supports the internal motor 11 with the (4) motor assembling bolts 10. The internal motor 11 is secured and attached to the (4) motor mounts 9 using the (4) motor assembling bolts 10 and tightened to fit appropriately to the (4) motor mounts 9. The A-frame 1 further composes the drive assembly that consists of the internal motor 11, the shaft locking coupling 8 and the telescoping shaft 3. Attaching the shaft locking coupling 8 that is appropriately assembled to the bottom portion of the outer section of the telescoping shaft 3 and compressed to the top portion of the internal motor 11. The shaft locking coupling 8 can be secured to the bottom of the telescoping shaft 3 and the top of the internal motor 11 by tightening the top and bottom (2) set screws on the shaft and the top of the internal motor 11 by tightening the top and bottom (2) set screws on the shaft locking coupling 8 to the proper torque. The shaft locking coupling 8 will support and strengthen the drive assembly. This view also slows the control panel 16 that is molded on the outside of the A-frame 1 that contains the on-off switch 17, a variable speed switch 18, a five (5) second delay switch 19, and the charger jack 20. This illustration cain be seen in its perspective view in FIG. 1.

Figure 2:
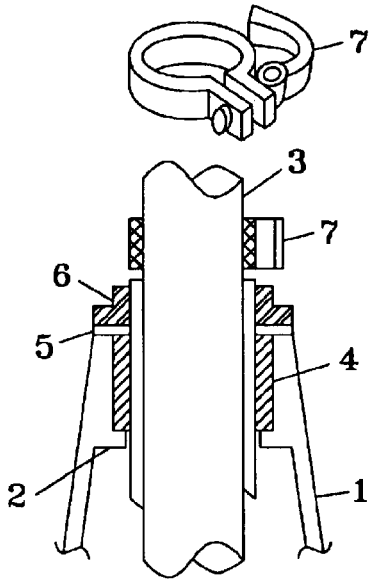
FIG. 2 shows the top portion of the apparatus on a larger scale, and a front view of the adjustable clamp.

Referring to FIG. 2, a partial top sectional view shows the top section of the A-frame 1 being flat and with a diameter of (app. 2") for the telescoping shaft 3 to be appropriately sized, fitted and passable through the top section of the A-frame 1, with the bearing seat 2, the shaft bearing 4, the shaft tab washier 5, the shaft locking nut 6 and the shaft locking clamp 7. The A-frame 1 housing die shaft bearing 4 appropriately fitted to die bearing seat 2 that is molded in the top center section of the A-frame 1. The top sectional view shows die telescoping shaft 3 passing through toe bearing seat 2 and die shaft bearing 4 that is fitted in the top section of the A-frame 1. The shaft tab washer 5 is passed over the top of the telescoping shaft 3 and next tie shaft locking nut 6 passing over die telescoping shaft 3 in position. Installing die shaft bearing 4 into the bearing seat 2, and passing the shaft tab washer 5, and the shaft locking nut 6 over the top outer section of the telescoping shaft 3 in its appropriate place and tightening together will support, strengthen and stabilize de telescoping shaft 3 to the top section of die A-frame 1 for a smooth stable rotation of the telescoping shaft 3. The shaft locking clamp 7 passes over the outer section of telescoping shaft 3 into position for locking or unlocking the adjustable height of the inner section to the outer section of the telescoping shaft 3. The shaft locking clamp 7 is a quick release lever and a screw type system for locking or unlocking the outer section to the inner section of the telescoping shaft 3. The tension given by the shaft locking clamp 7 screw may need to be adjusted by band. If the shaft locking clamp 7 lever glides easily into a locking position, the shaft locking clamp 7 screw needs to be tightened with a small amount of force to apply.

Figure 3:
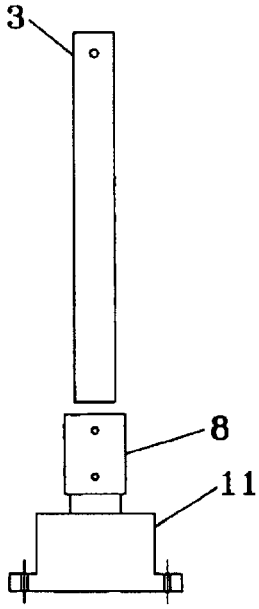
FIG. 3 shows the telescoping shaft, shaft locking coupling and the internal motor outside of the A-frame.

Referring to FIG. 3, a side elevated view showing the internal motor 11 attached to the shaft locking coupling 8 and the telescoping shaft 3 in its proper arrangement. The internal motor 11 is a battery powered rotor assembly like the battery-powered hand held drills and impact using a nickel metal hydride type rechargeable batter system that increase capability and allow users to perform longer between charges not shown. The view also shows the shaft locking coupling 8 compressed to the top portion of the internal motor 11, and appropriately assembled to the bottom portion of the outer section of the telescoping shaft 3 secured by tightening the top and bottom (2) set screws on the shaft locking coupling 8 to their proper torque. This view further shows the telescoping shaft 3 that is a 2 piece inter and elevating shaft 3 with the outer shaft 3 being (app. 16" tall) and the inner shaft 3 extending (app. 16" to 30" tall) and the top out section being threaded and tapered not shown to appropriately fit the bearing seat 2, the shaft bearing 4, the shaft tab washer 5, the shaft locking nut 6 and the shaft locking clamp 7 of the top section of the A-frame 1.

Figure 4:
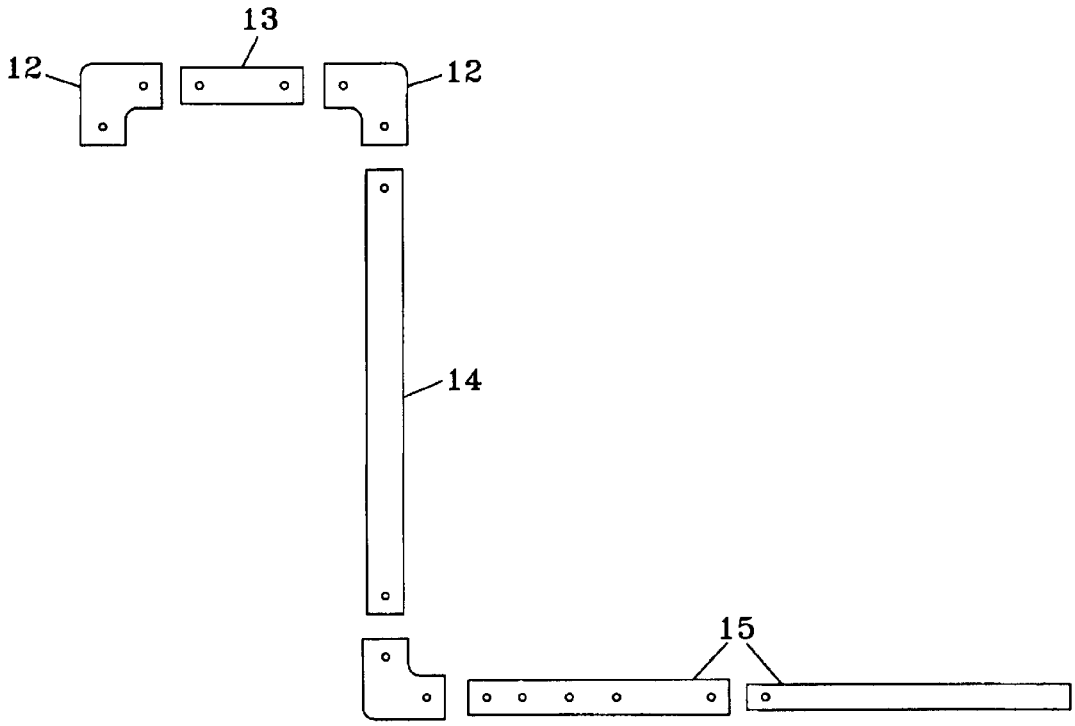
FIG. 4 shows a front view of the collar, horizontal extending, vertical extension leg and the horizontal extension bar forming a Z shape design.

Referring to FIG. 4, a front view of the collars, arm, leg, and bar is arranged that is assembled to the top inner section of the telescoping shaft 3. The parts contained in FIG. 4 consist of three (3) 90 degree locking snap button collars 12, a horizontal extending arm 13 (app. 7" long), a vertical extension leg 14 (app. 17" tall) and a horizontal extension bar 15 (adjustable from 16"–30" long), with these parts attached and forming a Z-shaped design and connected appropriately to the inner section of the telescoping shaft 3. The drive assembly would pulsate or rotate the attached parts around the axis of the apparatus.

Figure 5:
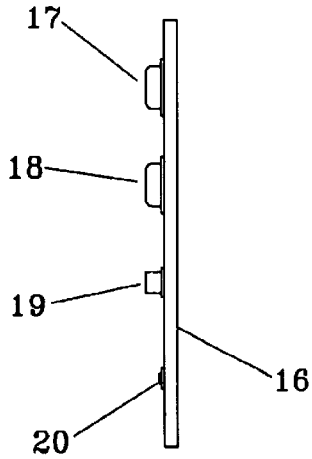
FIG. 5 shows a side view of the control panel, switches and charge jack that are attached on the outside of the frame.
Figure 6:
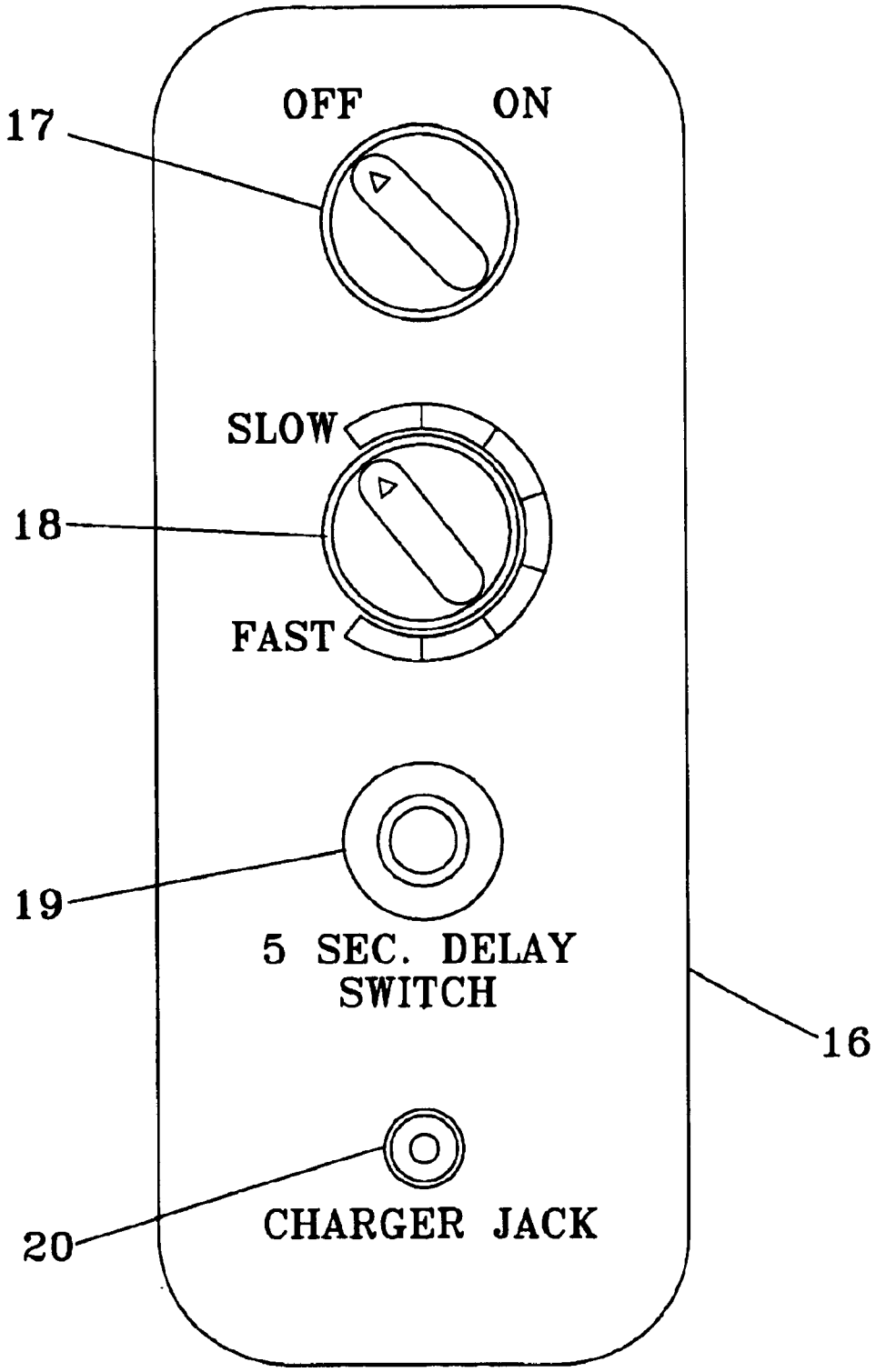
FIG. 6 shows an exploded view of the control panel and the arrangement of the switches and the charger jack.

Referring to FIGS. 5 and 6, is a view of the control panel 16 that is molded on the outside of the A-frame 1. The control panel 16 would house and support the on-off switch 17, a variable speed switch 18, a five (5) second delay switch 19, and the charger jack 20 by way of wiring not shown, with the on-off switch 17 and variable speed switch 18 the power and speed would operate and control the pulsating or rotation of the internal motor 11 as desired. A five (5) second delay switch 19 would shut off power to the internal motor 11, if accidentally tip over, and the charge jack 20 allow the user to recharge the power to the internal motor 11 by way of a charging source not shown.

Figure 7:
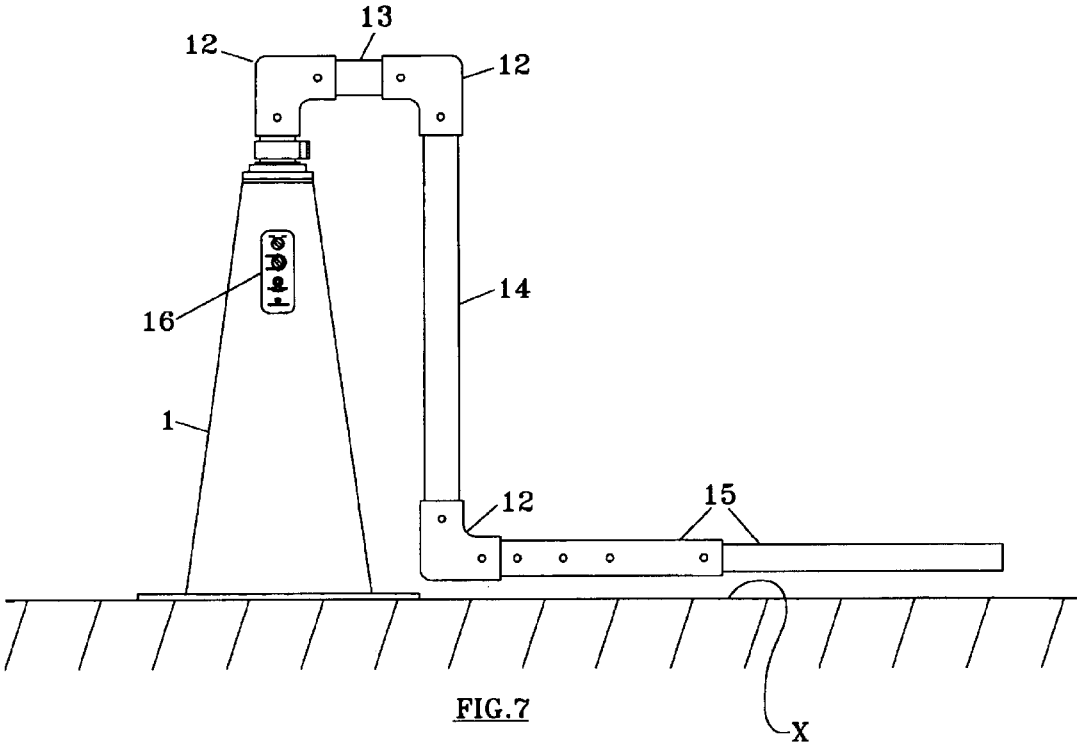
FIG. 7 shows a front perspective view of the apparatus as a single exercising assembly along said rotational axis.

Referring to FIG. 7 shows a front perspective view of a said single assembly along a said rotational axis of the apparatus.

Figure 8:
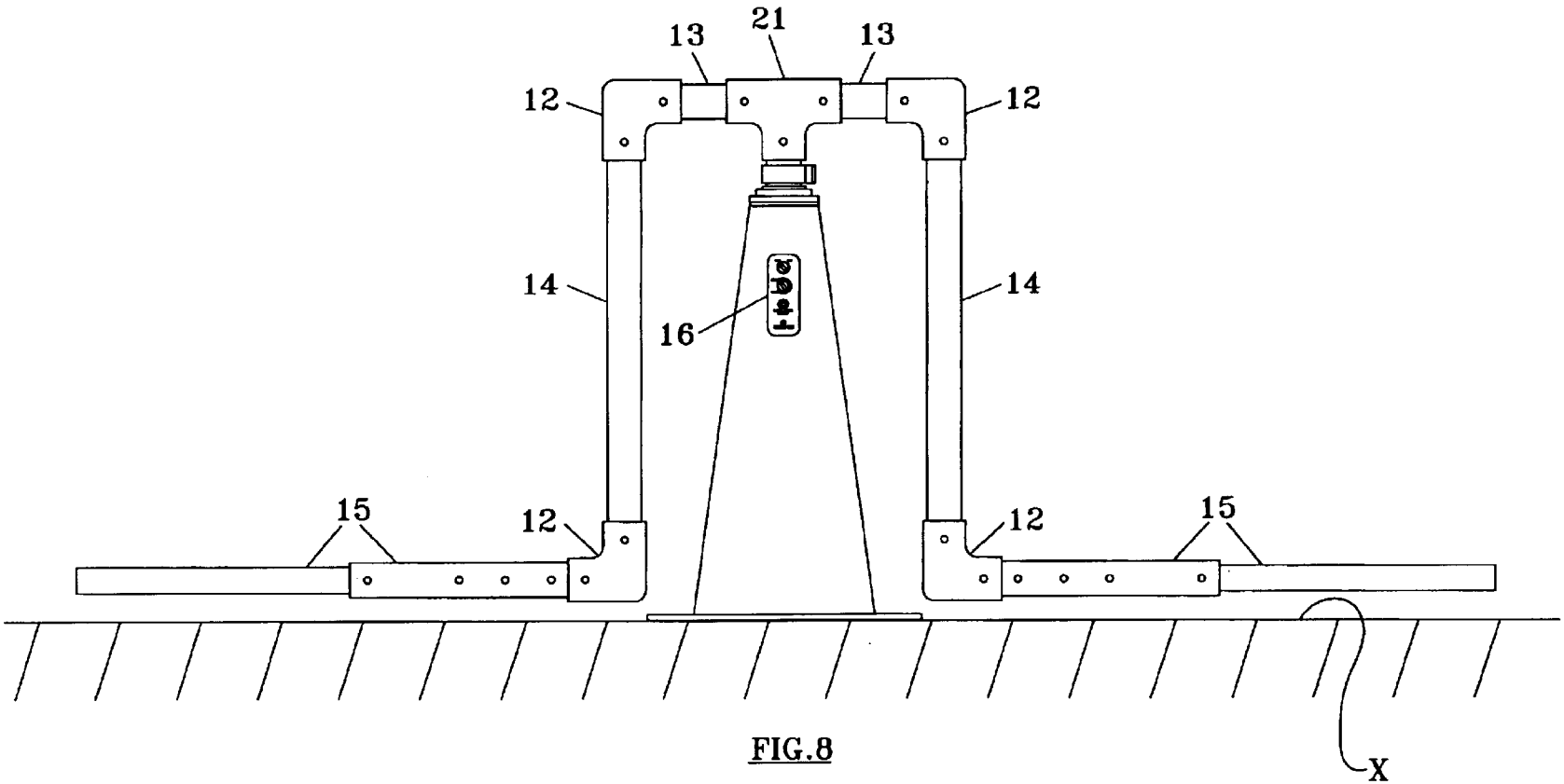
FIG. 8 shows a front perspective view of a dual jumping exercise apparatus along said rotational axis.

Referring to FIG. 8, shows a front perspective view of a said dual assembly along a said rotational axis of the apparatus. As an option the present invention could be constructed with a T-locking snap button collar 20, two (2) horizontal extending arms 13 (app. 7" long), two (2) vertical extension legs 14 (app. 17" tall), two (2) horizontal extension bars 15 (adjustable front 16"–30" long) and four (4) 90 degrees locking snap button collar 12. With these parts attached mid forming a dual assembly would rotate 360 degrees.

In yet another alternative embodiment of the present invention, the internal motor 11 could be manually controlled or remote controlled by the user not shown. As a safety precaution, the invention would be designed to have a five (5) second time delay switch 19 that would shut off power to the apparatus in the event that it would be accidentally tipped over. invention would be fabricated from plastic or fiberglass materials and various commercially available electrical and electronic components with bright attractive colors. In use a user would simply position the present invention on any level surface, adjusting the telescoping shaft 3 to a desired height and the horizontal extension bar 15 to a desired length. The internal motor 11 would then be activated at the on-off switch 17 and selecting the speed with variable speed switch 18, which would move the horizontal extension bar 15 back and forth at 180 degrees or 360 degrees. The user would jump over the horizontal extension bar 15 as it passes under his or her feet, for developing a human's alacrity helping to build leg muscles, increases endurance, provides a good cardiovascular workout, and help to improve coordination, confidence in his or her jumping abilities. The present invention would be suited for use by virtually anyone, whether a professional athlete, a home workout user, or even a child. This apparatus could be used on a daily basis and used by more than one person at a time, if desired.

What is claimed is:

1. A sport jump apparatus, comprising:

a. a support frame having a motor support, a motor having a vertically disposed output shaft and a vertically disposed bushing above said output shaft;

b. longitudinally telescoping drive shaft, rotatably disposed vertically through said bushing and coupled to said output shaft of said motor;

c. clamping means to fix the length of said drive shaft at a selected length thereof;

d. jump arm having a first horizontal portion attached to said drive shaft, a downwardly extending portion attached to said first horizontal portion; and a second horizontal portion attached to said downwardly extending portion; and, e. control means for rotatably oscillating said output shaft of said motor back and forth about a selected arc, at a selected rate of oscillation and speed.

2. The sport ump apparatus of claim 1 wherein said first horizontal portion of said jump arm extends horizontally a sufficient distance from said drive shaft so that said downwardly extending portion of said jump arm does not come into contact with said support frame when said output shaft is rotatably oscillated.

3. The sport jump apparatus of claim 2 wherein said second horizontal portion of said jump arm is telescopically adjustable within a range different lengths.

4. The sport jump apparatus of claim 2 wherein the height of the second horizontal portion of said jump arm is set to a desired height by adjusting the length of said longitudinally telescoping drive shaft.

5. The sport jump apparatus of claim 3 wherein the height of the second horizontal portion of said jump arm is set to a desired height by adjusting the length of said longitudinally telescoping drive shaft.

* * * * *